United States Patent [19]

Howorth

[11] Patent Number: 4,563,614

[45] Date of Patent: Jan. 7, 1986

[54] PHOTOCATHODE HAVING FIBER OPTIC FACEPLATE CONTAINING GLASS HAVING A LOW ANNEALING TEMPERATURE

[75] Inventor: Jonathan R. Howorth, Maldon, England

[73] Assignee: English Electric Valve Company Limited, Chelmsford, England

[21] Appl. No.: 694,251

[22] Filed: Jan. 24, 1985

Related U.S. Application Data

[63] Continuation of Ser. No. 353,955, Mar. 2, 1982, abandoned.

[30] Foreign Application Priority Data

Mar. 3, 1981 [GB] United Kingdom ..... 8106665

[51] Int. Cl.[4] ..... H01J 1/78; H01J 1/34; H01J 40/06

[52] U.S. Cl. ..... 313/524; 313/527; 313/542; 65/4.2

[58] Field of Search ..... 313/371, 372, 474, 524, 313/527, 542, 543; 65/4.2, 4.1; 350/96.29

[56] References Cited

U.S. PATENT DOCUMENTS

| | | | |
|---|---|---|---|
| 3,478,213 | 11/1969 | Simon et al. | 313/528 X |
| 3,575,628 | 4/1971 | Word | 313/525 |
| 3,586,895 | 6/1971 | Sowers et al. | 313/525 X |
| 3,672,992 | 6/1972 | Schaefer | 313/542 X |
| 3,769,536 | 10/1973 | Antypas et al. | 313/542 |
| 3,870,921 | 3/1975 | Burns | 313/542 X |
| 3,959,038 | 5/1976 | Gutierrez et al. | 313/542 X |
| 3,960,620 | 6/1976 | Ettenburg | 313/542 X |
| 4,119,363 | 10/1978 | Camlibel et al. | 350/96.2 |

FOREIGN PATENT DOCUMENTS

| | | |
|---|---|---|
| 1049586 | 11/1966 | United Kingdom . |
| 1081513 | 8/1967 | United Kingdom . |
| 1146455 | 3/1969 | United Kingdom . |

OTHER PUBLICATIONS

Kohl, Walter, *Materials and Techniques for Electron Tubes,* Reinhold, NY, 1960, pp. 608-609.

*Primary Examiner*—David K. Moore
*Assistant Examiner*—K. Wieder
*Attorney, Agent, or Firm*—Spencer & Frank

[57] ABSTRACT

A photocathode arrangement comprises a body of semiconductor material, such as gallium arsenide which is bonded to a fiber optic face plate. A thin anti-reflection coating of silicon nitride is positioned between the body and the plate and forms an integral part of the bond. The properties of the glasses from which the fiber optic face plate is made are carefully chosen to minimize crystal dislocations which can be introduced into the body of gallium arsenide when it is bonded to the face plate. Such crystal dislocations can seriously impair the performance of the photocathode. It has been found that it is advantageous to use a glass having an annealing temperature of about 575° C. or less. Because of high temperature processing steps, its softening temperature must be about 680° C. or greater. The photocathode arrangement so formed is intended to constitute the input port of an image intensifier.

8 Claims, 2 Drawing Figures

Figure 1:
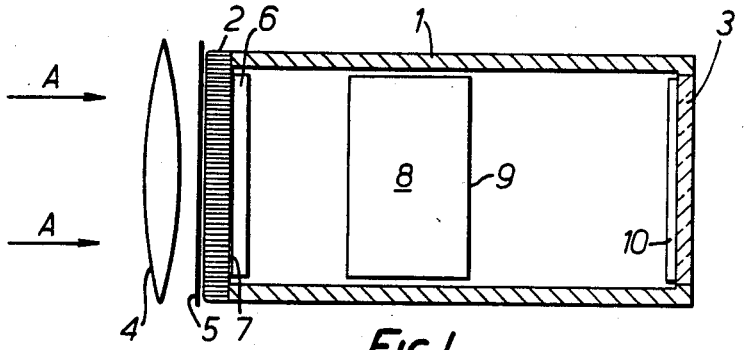

PHOTOCATHODE HAVING FIBER OPTIC FACEPLATE CONTAINING GLASS HAVING A LOW ANNEALING TEMPERATURE

This application is a continuation of application Ser. No. 353,955 filed Mar. 2, 1982 now abandoned.

This invention relates to photocathodes and is specifically concerned with photocathodes made from 3–5 compound semiconductors, for example having gallium arsenide as the major active material. In use, the photocathode is mounted within an evacuated envelope, such that when light falls upon the photocathode electrons are emitted from its surface and these electrons are multiplied by some form of electron multiplier—for example, a multiple dynode structure may be employed for this purpose or alternatively electron multipliers of the micro-channel plate kind can be used. The photocathode itself is relatively fragile and for this reason and to avoid unnecessary light loss it is usual to bond the photocathode to a transparent window which, in use, forms part of the wall of the evacuated envelope. For a number of reasons, it is desirable to constitute the glass window as a fibre optic face plate, but it has been found that when a semiconductor material such as gallium arsenide has been bonded to such a face plate instead of the usual plain glass window, its electrical performance is unexpectedly impaired. The present invention seeks to provide an improved photocathode arrangement and an image intensifier utilising it.

According to a first aspect of this invention, a photocathode arrangement includes a photosensitive electron emitter comprising a 3–5 compound semiconductor bonded to a fiber optic face plate in which the annealing temperature of the face plate is about 575° C. or less, its softening temperature is about 680° C. or greater, and the expansion co-efficient of its core glass lies between 5 and $8\times10^{-6}$ per degree C.

Preferably the 3–5 compound semiconductor is gallium arsenide. Other 3–5 compounds may be suitable, but may not be so satisfactory. Although the material is primarily gallium arsenide, it may be advantageous to include in its structure a small amount of an additive, such as indium.

Fiber optic face plates consist of a matrix of short lengths of core glass rods surrounded by sleeves of clad glass which extend between the two major faces of the plate, so that an optical image which is present at one of the major faces is transferred to the other with very little light loss, image degradation and loss of resolution. Because of the way in which the fiber optic face plates are made, the core glass necessarily has a higher annealing temperature then has the clad glass.

Although gallium arsenide photocathodes can be satisfactorily bonded to plain glass windows without causing significant impairment of its electrical properties such an arrangement has certain disadvantages. For example, high aperture lenses which are often used in conjunction with photocathodes of this kind have a very short back focal length which necessitates the use of an extremely thin glass window so that the photocathode can be positioned in the focal plane of the lens. This can result in an unacceptably weak window. Additionally, it is difficult to introduce graticule images into an optical system of this kind and to align the photocathode surface parallel to a suitable external reference plane.

These disadvantages can be alleviated by bonding the photocathode to a fiber optic face plate which forms part of the evacuated envelope within which the photocathode is mounted as incident light can then be brought to a focus at the outer surface of the face plate. In practice it has been found that the electrical properties of a gallium arsenide photocathode have been impaired when used with a fiber optic face plate, and in particular minority carrier diffusion length is reduced and surface recombination velocity is increased.

Examination of a photocathode by means of an electron microscope reveals that many extra crystal dislocations are caused by the bonding of it to a conventional fiber optic face plate. A number of possible explanations as to the cause of these dislocations were considered. For example, the temperature at which the bond is made is controlled by the softening temperature of the glass of which the face plate is composed, and this has to be relatively high to withstand subsequent processing at temperatures of the order of 600° C. Were it not for this subsequent processing a softer fiber optic could be used, and the bonding could be performed at a lower temperature. As has been mentioned, a fiber optic face plate consists of core glass and clad glass, and a temperature expansion co-efficient mismatch between these two glasses could be a source of local strain at the bond surface. Also the temperature expansion co-efficient mismatch between the glass and the gallium arsenide could similarly cause local strain.

Rather surprisingly it has been found that these considerations are not particularly relevant, and that instead the formation of crystal dislocations is highly dependent on the annealing temperature of the glass of fiber optic face plate, and an annealing temperature of about 575° C. for the core glass has been found to be sufficiently low to reduce dislocations to an acceptable level.

According to a second aspect of this invention, an image intensifier includes a photocathode which is in accordance with this invention and which is mounted within an evacuated envelope, the inner surface of the photocathode which is remote from the fiber optic face plate being treated so as to reduce its effective work function, so that when light falls upon the photosensitive surface of the photocathode via the fiber optic face plate electrons are emitted from said inner surface; and an electron multiplier also mounted within the evacuated envelope and arranged to receive and multiply the emitted electrons.

Figure 2:
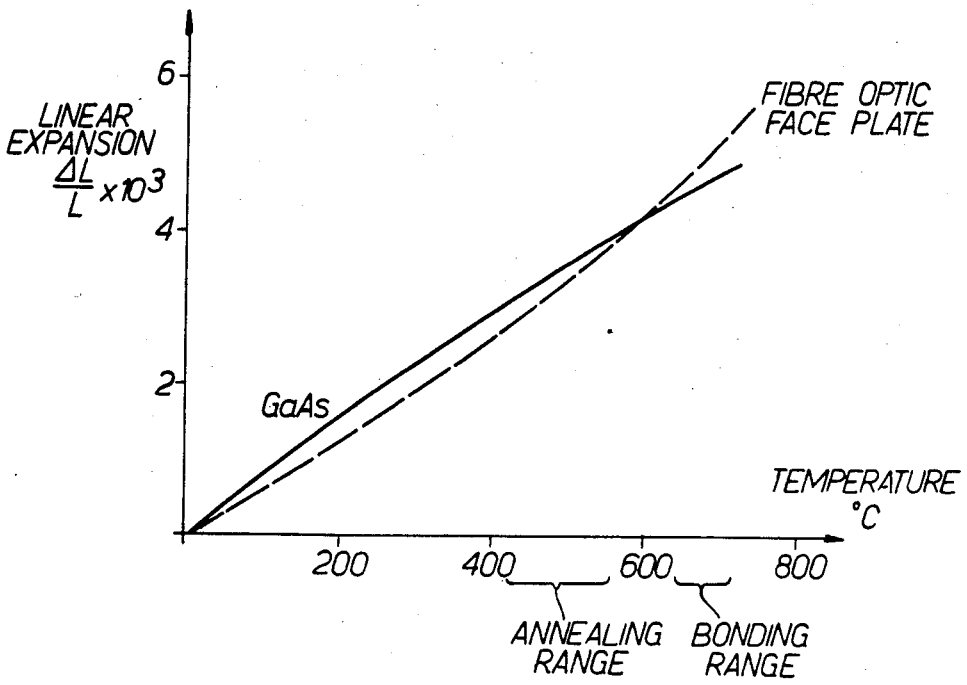

The invention is further described by way of example with reference to the accompanying drawing, in which FIG. 1 shows an image intensifier incorporating a photocathode in accordance with the invention, and FIG. 2 is an explanatory diagram.

Referring to FIG. 1, an evacuated envelope 1 which is of generally cylindrical form has a fiber optic face plate 2 located at one end and a transparent output window 3 located at its other end. Image intensifiers are frequently used to amplify very weak optical images and are particularly suitable for surveillance applications under very low light conditions. Low level illumination is received as indicated by arrows A and the image is gathered by a wide aperture lens 4 and brought to a focus at the front surface of the face plate 2. The lens 4 has a very short back focal length, which is just sufficient for a thin glass plate 5 carrying a graticule image on its rear surface to be positioned immediately in front of the face plate 2. The graticule is on the rear surface of the plate 5 so that an optical image of it, together with the optical imaged formed by the lens 4 are transferred to the inner surface of the face plate 2 in known manner. Fiber optic face plates are known devices which consist of a matrix of very thin core glass rods surrounded by a clad glass sleeve. They allow images to be transferred from one side of the face plate to the other with very low attenuation, whilst preserving optical resolution and image quality. The face plate is particularly advantageous in the present application, since it enables the optical image to be formed at its outer surface closely adjacent to the lens 4.

A thin photocathode 6 is bonded to the inside of the face plate 2 with a thin film 7 positioned between them to constitute an anti-reflection coating. The photocathode 6 generates electrons in accordance with the optical image which is projected upon it and these electrons are greatly multiplied by an electron multiplier 8. The multiplier 8 may be a multiple dynode structure in which the number of electrons are progressively multiplied by a small factor at a number of sequential dynodes. However, it is preferred that the electron multiplier 8 is a micro-channel plate multiplier. Electrons are copiously emitted from the rear surface 9 of the electron multiplier and are incident upon a fluorescent screen 10, which produces a very intense optical image which is a replica (which may be optically positive or negative) of the original image produced by the lens 4. The light produced by the fluorescent screen 10 is viewed through the transparent window 3.

Gallium arsenide is a particularly useful material from which to form the photocathode 6 and it has been previously proposed to use it in contact with the inner surface of a plain glass window. However, as previously described the performance of such a photocathode does not meet expectations when it is bonded to the inside of a fiber optic face plate. The performance of the gallium arsenide photocathode can be greatly improved by using a fiber optic face plate formed of glass having particular and carefully chosen characteristics. In particular, the annealing temperatures of the glasses of which the plate is composed and their co-efficients of thermal expansion has been found to be particularly critical.

The photocathode arrangement which comprises the photocathode 6 in combination with the face plate 2 can be fabricated as follows. A thin substrate of gallium arsenide has a thin film of gallium aluminium arsenide ($Ga_{0.3}Al_{0.7}As$) formed upon it. Then a layer of epitaxial gallium arsenide is grown upon it in accordance with a conventional process. Epitaxial growth of appropriate semiconductor materials is now well known and it is not thought necessary to describe this process in detail. The growth is continued until the thickness of the epitaxial layer is about 2.5 to 3 microns. A further thin film of gallium aluminium arsenide is then laid down and subsequently a very thin layer of silicon nitride is deposited on to it to constitute an anti-reflection coating. The thickness of this coating will, of course, be chosen with its anti-reflection properties in mind, but it is likely to be of the order of 1000 angstroms.

The films of gallium aluminium arsenide are also epitaxial in nature, and are transparent. These films serve to reduce the back surface recombination velocity of the photocathode, and the first such film also acts as an etchant barrier for subsequent processing. The gallium arsenide substrate is then placed upon a heatable plate with the anti-reflection coating uppermost. A fiber optic face plate is then brought into contact with this coating, and the heatable plate is heated in a controlled manner to near the softening temperature of the glass. When this temperature has been reached, the fiber optic face plate is pressed firmly and evenly towards the gallium arsenide. At this temperature the intervening coating of silicon nitride is partially absorbed into the surface of the fiber optic face plate and a strong bond is formed in which the gallium arsenide is held firmly to the fiber optic face plate. Subsequently the original gallium arsenide substrate is etched away to leave just a portion of the grown epitaxial gallium arsenide layer of about 1.5 microns thick. The gallium arsenide can be etched using a conventional etchant comprising, for example, suphuric acid and hydrogen peroxide—the etch process stops when the first film of gallium aluminium arsenide is reached. This first film is then itself removed by a suitable etch, such as hydrofluoric acid to leave an exposed surface of gallium arsenide.

The resulting photocathode structure is then heated in a vacuum to a temperature of the order of 600° C. to produce an atomically clean surface which is then exposed to controlled traces of a low work function material such as cesium oxide, cesium fluoride or rubidium oxide. Materials of this kind ensure that the work function of the photocathode is sufficiently low to enhance the emission of photo electrons from it when the photocathode is illuminated by light. Whilst the vacuum is maintained the photocathode arrangement is sealed onto the remainder of the image intensifier which already contains the photo multiplier 8, and the envelope is then sealed to maintain the vacuum.

FIG. 2 shows variation of linear expansions of gallium arsenide and a typical fiber optic glass against temperature. The linear expansion figures of fiber optic glass represent the mean of the separate expansions of the core glass and clad glass. The bonding temperature range occurs in the region of just below the softening temperature of the glass and is of the order of 700° C. - a typical figure is 680° C. The softening temperature of the glass is defined in terms of a viscosity of $10^8$ poises. As it cools the glass is able to accommodate stess resulting from the co-efficient mismatch relative to the gallium arsenide until it reaches its annealing temperature which is of the order of 575° C. - this temperature is defined by a viscosity of $10^{13}$ poises. The composite co-efficient of expansion for the glass face plate (i.e. the mean figure for core glass and clad glass) over the temperature range of 20° C. to 450° C. is between $5\times10^{-6}$ and $8\times10^{-6}$/°C. Even glass having a good thermal co-efficient match with that of gallium arsenide can cause crystal disorders in the photocathode if its annealing temperature is materially above the figure of 575° C.

The required annealing temperature for the core and clad glass of the fiber optic face plate can be achieved using borosilicate with suitable additions of various oxides. Fiber optic face plates having suitable properties as set out above are available from Galileo Electro-Optics Corporation, U.S.A. under the designation ET0959. This face plate contains core glass having a thermal expansion co-efficient of $6.9\times10^{-6}$/°C., a softening temperature of 720° C., and an annealing temperature of 550° C. The clad glass has a thermal expansion co-efficient of $4.8\times10^{-6}$/°C., a softening temperature of 695° C. and an annealing temperature of 480° C. The composite thermal expansion co-efficient of the face plate as a whole is about $6.3\times10^{-6}$/° C. and its bonding temperature is about 660° C. As before the softening temperature is defined as the temperature at which the glass has a viscosity of $10^8$ poises and the annealing temperature as corresponding to a viscosity of 10—poises.

I claim:

1. A photocathode arrangement including a photosensitive electron emitter comprising a 3–5 compound semiconductor bonded to a fiber optic face plate consisting of core glass and clad glass in which the annealing temperatures of both glasses are not greater than about 575° C., to thereby minimize the formation of crystal dislocations in said emitter, and in which the softening temperatures of the core glass and the clad glass are both not less than about 680° C., and the expansion coefficient of the core glass lies between 5 and $8\times10^{-}$≠per degree C.

2. A photocathode arrangement as claimed in claim 1 wherein the 3–5 compound semiconductor is primarily gallium arsenide.

3. A photocathode arrangement as claimed in claim 2 wherein the electron emitter comprises a body of epitaxial gallium arsenide.

4. A photocathode arrangement as claimed in claim 3 wherein a thin anti-reflection coating is present between the body of epitaxial gallium arsenide and the fibre optic face plate.

5. A photocathode arrangement as claimed in claim 4 wherein the anti-reflection coating is silicon nitride.

6. A photocathode arrangement as claimed in claim 2 and having an electron emissive surface containing traces of a material which reduces the work function of the gallium arsenide.

7. An image intensifier including a photocathode as claimed in claim 1.

8. A fiber optic face plate for bonding to a photosensitive electron emitter composed of a 3–5 semiconductor compound to form a photocathode arrangement, said face plate consisting of core glass and clad glass inn which the annealing temperatures of both glasses are not greater than about 575° C., to thereby minimize crystal dislocations in the emitter, and in which the softening temperatures of the core glass and the clad glass are both not less than about 680° C., and the expansion coefficient of the core glass lies between 5 and $8\times10^{31\ 6}$ per degree C.

* * * * *